United States Patent [19]

Okada

[11] Patent Number: 4,934,520

[45] Date of Patent: Jun. 19, 1990

[54] PORTABLE VALUABLES RECEPTACLE

[76] Inventor: Akiko Okada, No. 25-7-102, 2-chome, Sakuradai, Nerima-ku, Tokyo, Japan

[21] Appl. No.: 355,925

[22] Filed: May 23, 1989

[51] Int. Cl.[5] ..... A45C 11/18

[52] U.S. Cl. ..... 206/37; 206/39; 150/134; 150/145; 150/147

[58] Field of Search ..... 150/134, 147, 145; 206/37, 39, 38

[56] References Cited

U.S. PATENT DOCUMENTS 1,127,363 2/1915 Kallnbach ..... 150/134

FOREIGN PATENT DOCUMENTS 465993 9/1928 Fed. Rep. of Germany ..... 150/134

7713466 9/1978 Sweden ..... 150/134

*Primary Examiner*—William Price

*Attorney, Agent, or Firm*—Dilworth & Barrese

[57] ABSTRACT

A portable valuables receptacle is disclosed which includes a mechanism for prevention of slippage of the receptacle out of a garment pocket in which it is positioned, and which further prevents removal thereof from the pocket by a pickpocket. A slide plate provided with a portion for reception of valuables is slidably mounted within a case and movable between two positions, one being a locked position and the second being a released position. In the released position the slide plate is moved outwardly of the case by spring action, thus causing the case and the slide plate to expand against the side margins of the garment pocket in which it is placed, thus placing a force against the side margins and thereby preventing removal thereof from the garment pocket. The valuables receptacle portion of the slide plate is arranged to receive valuable personal belongings such as a commutation ticket, driver's license, a key or the like.

13 Claims, 4 Drawing Sheets

FIG.4
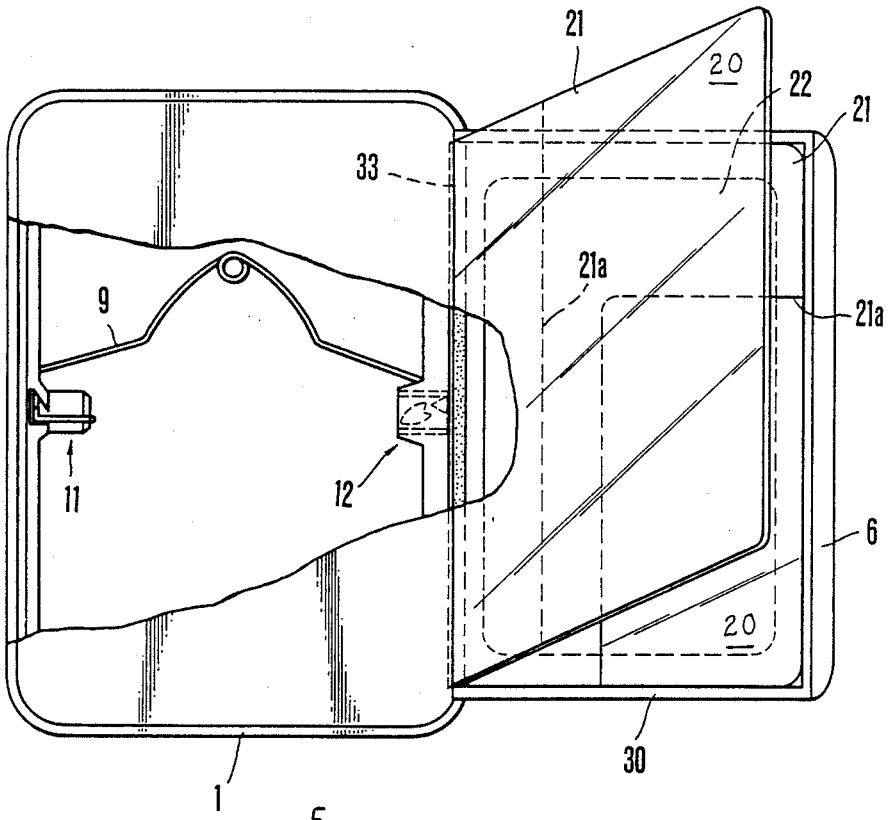
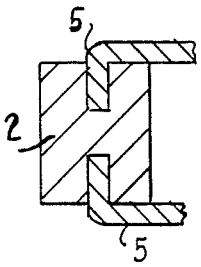
FIG 5

PORTABLE VALUABLES RECEPTACLE

BACKGROUND OF THE INVENTION

1. FIELD OF THE INVENTION

The present invention relates to a portable valuables receptacle; and more particularly relates to a portable valuables receptacle for carrying such personal belongings as various cards such as a ticket, a driver's license, etc. or a key.

2. Description of Related Art

Hitherto, such valuable personal belongings as a driver's license card, a commutation ticket or a key etc. have been carried by placing the same into receptacle which is in general put into a pocket. However, when said receptacle is carried in a manner as described above, it is apt to slip or to be lost due to slipping out of the pocket on the occasion of taking off a coat or bending the body etc. Furthermore, since the receptacle may be easily taken out of the pocket, it is possibly for the receptacle to fall victim to a pickpocket.

Therefore, it would be desirable to prevent the receptacle from slipping out of the pocket with ease.

SUMMARY OF THE INVENTION

With the above in mind, it is an object of the present invention to provide a portable valuables receptacle provided with a falling-off preventive mechanism for preventing the receptacle put into a pocket from slipping off and further preventing it from falling a victim to a pickpocket.

The aforementioned object can be attained by providing a portable valuables receptacle comprising: a combination dimensioned for reception into a garment pocket receiving case (1) having the size of a pocket book and providing with an opening (4) at one side of said receiving case and a slide plate (6) provided with a valuables receiving portion which slidably moves inwardly and outwardly of said receiving case, a holding portion (11) being mounted within said receiving case, an engaging portion (12) being mounted at the slide plate (6), a lock means (10) being constituted by means of said holding portion and engaging portion, said engaging portion being locked to said holding portion or released therefrom by movement of said slide plate into the receiving case, and stoppers (8,8) and projections (7,7) being mounted at the receiving case and slide plate so as to prevent removal of said slide plate.

By forcing a slide plate (6) into a receiving case (1) with fingers against a spring (9), a tongue plate (13) is caused to enter into a convex portion (15) of the slide plate (6) so that a lock nail portion (14*a*) of a lock spring (14) engages with a lock convex (16*a*) of a cam (16) having an approximately heart shape and disposed within said convex portion (15) so as to firmly lock the slide plate.

On the other hand by forcing the slide plate (6) into said receiving case with fingers to release the locking state, the lock nail portion (14*a*) is released from the lock convex (16*a*) so as to release the slide plate by means of the spring (9). The slide plate (6) can be prevented from falling out of case (1) by means of stoppers (8,8) and projections (7,7) mounted on said receiving case and slide respectively. When the slide plate is released, it expands within the user's garment pocket so that the respective ends of said receiving case (1) and slide plate (6) are in engagement with the sewed ends of the pocket due to the releasing force of the slide plate;

The engagement of these components against the end portions of the user's pocket prevents the valuables receptacle from easily slipping off or being pulled out of the garment pocket.

BRIEF DESCRIPTION OF THE DRAWINGS

In the FIGS;

FIG. 4 is a partially perspective view of said receptacle, one portion of which is cut away.

FIG. 5 is a cross-sectional view of the side wall illustrating the mounting of the side plates to the case.

DETAILED DESCRIPTION OF THE PREFERRED EMBODIMENT:

Hereinafter, embodiments according to the present invention will be described in detail with reference to the drawings.

Figure 1:
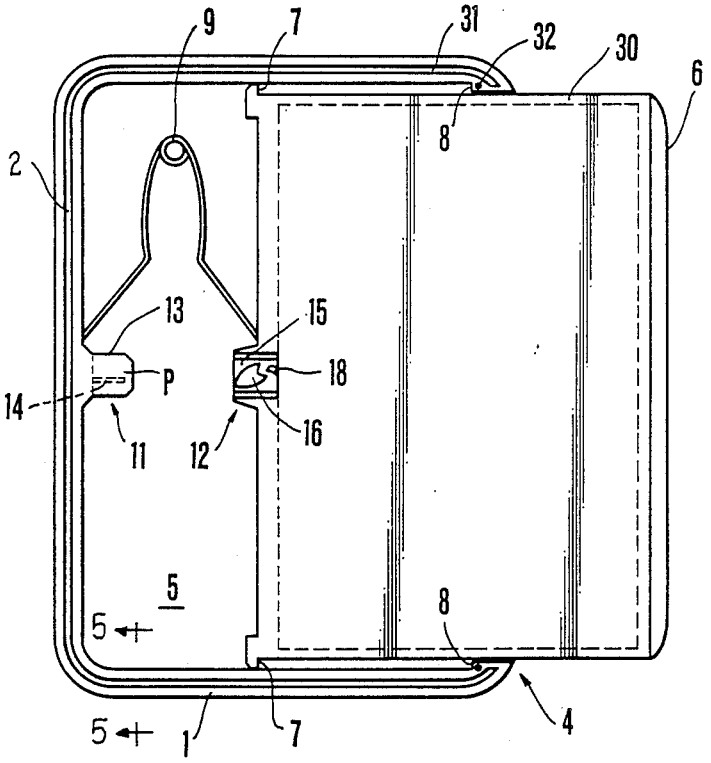
FIG. 1 is a plan view showing the inside of a portable valuables receptacles according to the present invention.

In FIG. 1, a receiving case (1) provided with an opening (4) at one side thereof is formed to have a pocket book size having almost the same size as that of a garment pocket and is surrounded by an end wall (2) along three sides and further covered with a side plate (5) and the other side plate. (not illustrated)

Within the receiving case (1), a slide plate (6) is mounted and said slide plate (6) is slidably guided to go in and out of the opening (4). Projections (7,7) which are formed at both sides of said slide plate (6) engage with stoppers (8,8) formed at said opening of the receiving case so as to prevent said slide plate from falling out of case (1).

The receiving case (1) and slide plate (6) are made of a thin metallic or synthetic plastics plate.

According to the embodiment illustrated in FIG. 1, the slide plate(6) is formed in the shape of a plate surrounded by a raised edge(30) along the periphery thereof. However, the shape of said receiving case may be formed to be provided with a lid or may also be formed to be a tubular body in the shape of a plate.

The receiving case (1) is usually formed to have the size of a pocket i.e. a size which fits into a garment pocket. However, said size can suitably be selected depending upon the size of a garment pocket.

A spring (9) is mounted between the slide plate (6) and the receiving case (1) so as to bias releasing forth towards the exterior through an opening (4). The shape of said spring (9) is not limited to that illustrated in FIG. 1 and such a suitable spring as a coil spring etc may also be employed.

A locking means (10) for locking the slide plate (6) is mounted in a manner that said plate is forced into the inside of the receiving case (1) against the spring (9). Said lock means consists of a holding portion (11) mounted at the receiving case (1) and an engaging portion (12) mounted at the slide plate (6).

Figure 2:
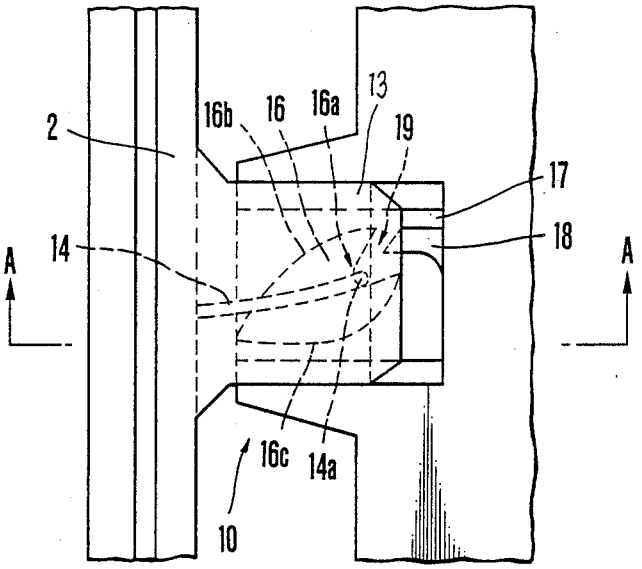
FIG. 2 is a plan view partly showing a lock means according to the present invention.
Figure 3:
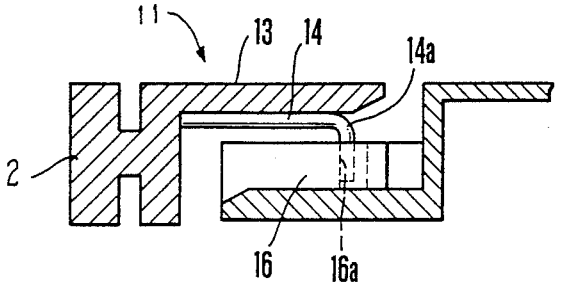
FIG. 3 is a sectional view taken along line A—A in FIG. 2.

Said holding portion (11) includes a tongue plate (13) and a lock spring (14) projectingly mounted at an end wall (2) of the receiving case illustrated in FIGS. 1 and 2. Said lock spring is firmly fixed to the receiving case at the base thereof. The other end of the lock spring (14) extends towards the front end of the tongue plate (13) in a manner that said other end almost abuts said tongue and is further provided with a lock nail portion(14*a*) in the shape of an L.

The engaging portion (12) mounted at the slide plate (6) provides a convex portion (15) into which the tongue plate (13) of the receiving case (1) is inserted and a cam (16) disposed within said convex portion. Said cam is formed in the shape of approximately a heart and provides a lock convex (16*a*) corresponding to the convex portion in the shape of a heart and a semi-outer peripheral surface i.e. an upper side surface(16*b*) and the other semi-outer peripheral surface i.e. a lower side surface (16*c*) as illustrated in FIG. 2. The upper side surface (16*b*) is formed as a lock engagement guide surface and the lower side surface (16*c*) is formed as a lock disengagement guide surface. Of course, said surfaces (16*b*, 16*c*) may be formed inversely.

According to the embodiment as illustrated in FIG. 2, the lock spring (14) is disposed in a manner that the lock nail portion (14*a*) is pressed down by means of the cam (16) and the lock convex portion (16*a*) when the slide plate (6) is manually pushed into case (1). Thus the lock nail portion (14*a*) engages cam (16) in groove (19) after sliding past surface (16*c*). Lock nail portion (14*a*) thus retains slide plate (6) in the locked position. When the slide plate (6) is pushed further inward, lock nail (14) —which is biased upwardly toward convex suface (16*b*) —then moves upwardly (i.e., in FIG. 2) and slidably engages convex surface (16*b*) as spring (9) resiliently moves slide plate (6) outwardly of case (1). Thus to summarize, when the slide plate (6) is pushed inwardly it is locked within case (1). To release the slide plate (6), the user manually pushes plate (6) further inward causing release of the locked state and thereby permitting the slide plate to withdraw from the case (1).

As groove (31) is provided for fitting the side plate(5) thereinto and (32) is a screw hole for fixing said side plate thereinto.

As illustrated in FIG. 1, when the slide plate (6) is forced into the receiving case in an unlocking state, the tongue plate (13) of the receiving case (1) is forced into the convex portion (15) of the slide plate (6). When said tongue plate is forced into the convex portion, the lock nail portion (14*a*) of the lock spring (14) disposed at the back of the tongue plate abuts the lock engagement guide surface (16*b*) of the cam (16) so that it is slidably pushed up onto the upper side surface against the spring force. By forcing the slide plate (6) into the receiving case until the front end of the tongue plate (13) abuts the innermost recess of the convex portion (15), the lock nail portion (14*a*) is once forced into a clearance groove (17) of the convex portion (15) from the surface of the cam (16). Releasing the fingers at that position, the slide plate (6) is caused to slip off towards the outside due to the biasing force of the spring (9). At that time, the lock nail portion (14*a*) is guided towards a guide groove (19) formed in between a projection (18) forming the clearance groove (17) and the cam (16) due to the elasticity of the lock spring (14) so as to engage with the lock convex portion (16*a*). Thus, the slide plate (6) is locked so as not to get way from the receiving case. The slide plate (6) is released from the locked state by forcing it inwardly into the receiving case (1) with the user's fingers. By this inward movement the lock nail portion (14*a*) is released from the lock convex portion (16*a*) by the elasticity of the lock spring (14) which is biased toward its unloaded position. Releasing the fingers subsequently, the slide plate is forced out due to the biasing force of the spring (9). At that time, the lock nail portion (14*a*) is slidably guided to the lock disengagement guide surface (16*c*).

When the slide plate (6) is extended out of case (1) and projections (7,7) of the slide plate (6) are latched by means of the stoppers (8,8) , the lock nail portion (14*a*) moves to the lock engagement guide surface (16*b*) from the lock disengagement guide surface (16*c*) as the result of returning to a natural position(P) of the lock spring (14).

When the slide plate (6) is forced into the receiving case (1) with fingers once again, the lock nail portion (14*a*) of the lock spring (14) is guided onto the lock engagement guide surface (16*b*) of the cam (16) so as to enter into the clearance groove (17) and further moves to the convex portion (16*a*) from the guide groove (19). Thereafter, each action of locking engagement and disengagement is repeated by forcing the slide plate into the receiving case with fingers.

When the portable valuables receptacle provided with a falling off preventive mechanism according to the present invention is used, such cards as a commutation ticket, a driver's license card etc. are put within the slide plate (6) moved slidably outwards by releasing the locking state and thereafter said slide plate (6) is forced into the receiving case (1) with fingers. It is preferable to mount an inside pocket (20) at the slide plate as described hereinafter because the cards thus placed therein do not become exposed out of the inside of said slide plate.

Next, by forcing the slide plate (6) into the receiving case (1) put within a pocket or from the outside thereof with fingers at the locking state of said slide plate, the slide plate expands within the garment pocket by releasing said locking state against the sewn side portions of the garment pocket. Since said slide plate is biased outside by means of the spring (9), a portable valuables receptacle thus put into the pocket with the width effective for providing the biasing force of said spring (9) will not easily slip out of the garment pocket thus providing no fear of being pulled out. When the portable valuables receptacle is taken out of the pocket, it can easily be taken out by forcing the slide plate (6) into the receiving case (1) so as to constitute a locking state.

It is preferable to mount a pocket made of synthetic resin sheet such as vinyl etc within the slide plate and one side of the receiving case or to mount a cover portion with a plurality of pockets at the receiving case for utilizing the portable valuables receptacle more conveniently.

FIG. 4 illustrates another embodiment of the portable valuables receptacle according to the present invention, wherein an inside pocket (20) made of synthetic resin sheet such as vinyl etc. is mounted within the slide plate (6). Said inside pocket is hinged at the side of the slide plate provided with the engaging portion (12) of said slide plate. According to the embodiment illustrated in FIG. 4, a window (22) is perforated in the slide plate (6) so as to see a commutation ticket, a driver's license card etc. put within the inside pocket (20) in every direction of said slide plate. Said window is also convenient for pushing the inside pocket upwards with finger tip so as to put in or take out the commutation ticket etc. Said inside pocket (20) has such function as preventing from falling off of various kinds of a cards put in the slide plate by covering it at the time of forcing into or out said slide plate. (21*a*) is an opening of the inside pockets (20).

According to the present invention, it can easily and surely be carried out to put the inside plate into the receiving case to be a locking state or to release said slide plate from the receiving case by releasing said locking state merely by forcing the slide plate into the receiving case and the portable valuables receptacle does not easily slip off from a pocket unnecessarily due to the slide plate expandable within the pocket.

What is claimed is:

1. A portable receptacle for valuables or the like which comprises a receiving case (1) provided with an opening along at least one side for reception of a slide plate (6), said slide plate (6) being provided with means for retaining valuables or the like and being mounted for slidable movement to a first position into and a second position out of said receiving case (1), holding means connected to said receiving case, means connected to said slide plate for engaged reception with said holding means when said slide plate is slidably positioned within said receiving case so as to retain said slide plate in said first position, resilient means to bias said slide plate toward said second position, and means to release said slide plate from said first position to permit said slide plate to slide outwardly of said case to said second position.

2. The portable valuables receptacle according to claim 1, wherein said slide plate (6) is provided with a valuables receiving portion.

3. The portable valuables receptacle according to claim 1, wherein said slide plate (6) is provided with a window (22) at the bottom portion thereof.

4. The portable valuables receptacle according to claim 2 or 3, wherein said slide plate is provided with an inside pocket (20), one side of which is hinged to said slide plate and is made of plurality of sheets or a single sheet of a thin synthetic resin.

5. The portable receptacle for valuables or the like according to claim 2 wherein said valuables receiving portion is formed in the shape of a plate.

6. The portable receptacle for valuables or the like according to claim 2 wherein said holding means comprises a lock nail portion (14*a*) connected to a lock spring.

7. The portable receptacle for valuables or the like according to claim 6 wherein said means connected to said slide plate for engaged reception with said holding means comprises a cam means having a concave portion defined for locked reception of said lock nail portion to retain said slide plate in said first position.

8. The portable receptacle for valuables or the like according to claim 7 wherein said cam means defines at least one convex surface portion engageable by said lock nail portion when said slide plate is manually moved toward said first position, said convex surface portion being shaped to guide said lock nail portion into said concave portion for locked reception of said lock nail portion.

9. The portable receptacle for valuables or the like according to claim 8 wherein said cam means defines a second convex surface portion engageable by said lock nail portion when said slide plate is pushed manually further inward of said case (1), said lock nail portion being biased toward a released position relative to said concave portion such that said slide plate (6) is thereby permitted to move toward said second position under the force of said resilient means.

10. The portable receptacle for valuables or the like according to claim 9 wherein said cam means and said lock nail portion are relatively positioned such that said lock nail portion is released from said locked state with said cam means due to the resilient action of said lock spring when said slide plate (6) is pushed further inward of said case (1).

11. The portable receptacle for valuables or the like according to claim 10 further comprising means for preventing said slide plate (6) from removal from said case (1).

12. A portable receptacle for valuables or the like which comprises a receiving case (1) provided with an opening along one side for reception of a slide plate (6), said slide plate (6) being provided with means for retaining valuables or the like and being mounted for slidable movement to a first position into said receiving case (1) and to a second position out of said receiving case (1), holding means having a lock nail portion (14*a*) connected to said receiving case, means connected to said slide plate for engaged reception with said lock nail portion (14*a*) of said holding means when said slide plate is slidably positioned within said receiving case so as to retain said slide plate in said first position, resilient means to bias said slide plate toward said second position, and means structured and engaged to release said slide plate from said first position when said slide plate is moved further inwardly of said first position to permit said slide plate to slide outwardly of said case (1) by the force of said resilient means to said second position.

13. A portable receptacle for valuables or the like for positioning within a garment pocket which comprises a receiving case (1) provided with an opening along one side for reception of a slide plate (6), said slide plate (6) being provided with means for retaining valuables or the like and being mounted for slidable movement to a first position into said receiving case (1) and to a second position out of said receiving case (1), holding means having a lock nail portion (14*a*) connected to said receiving case, locking means connected to said slide plate for engaged reception with said lock nail portion (14*a*) of said holding means when said slide plate is slidably positioned within said receiving case so as to retain said slide plate in said first position, said lock nail portion being biased toward a rest position which causes to engage said locking means of said slide plate to retain said slide plate in said first position, resilient means to bias said slide plate toward said second position, and means structured and arranged to release said slide plate from said first position when said slide plate is moved further inward of said first position to permit said slide plate to slide outwardly of said case to said second position under the force of said resilient means whereby said case (1) and said slide plate (6) respectively engage the side end portions of the garment pocket to prevent ready removal therefrom due to the force against said side end portions and further movement of said slide plate to said first portion causes said slide plate to be locked in said first portion thereby relieving the force against said side end portions of the garment pocket.

* * * * *

UNITED STATES PATENT AND TRADEMARK OFFICE

CERTIFICATE OF CORRECTION

PATENT NO. : 4,934,520

DATED : June 19, 1990

INVENTOR(S) : Akiko OKADA

It is certified that error appears in the above-identified patent and that said Letters Patent is hereby corrected as shown below:

Title Page, Column 1, between lines

"[22] Filed: May 23, 1989" and "[51] Int. Cl.[5]... .....A45C 11/18",

Insert:

--[30] Foreign Application Priority Data
April 11, 1989 [JP] Japan.....[UM]42327/1989--.

Signed and Sealed this

Twenty-eighth Day of January, 1992

*Attest:*

HARRY F. MANBECK, JR.

*Attesting Officer*

*Commissioner of Patents and Trademarks*